United States Patent [19]

Seiler et al.

[11] Patent Number: 4,457,244

[45] Date of Patent: Jul. 3, 1984

[54] ROTARY-GRIPPER COUNTER-HOOK FOR DOUBLE-LOCK-STITCH SEWING MACHINES

[75] Inventors: Klaus D. Seiler, Kirchlengern; Wilhelm Stapel, Bünde; Günther Droste, Leopoldshöhe, all of Fed. Rep. of Germany

[73] Assignee: Dürkoppewerke GmbH, Bielefeld, Fed. Rep. of Germany

[21] Appl. No.: 246,413

[22] Filed: Mar. 23, 1981

Related U.S. Application Data

[63] Continuation-in-part of Ser. No. 214,113, Dec. 8, 1980, abandoned, which is a continuation of Ser. No. 5,781, Jan. 23, 1979, abandoned.

[30] Foreign Application Priority Data

Jan. 30, 1978 [DE] Fed. Rep. of Germany ..... 2803971

[51] Int. Cl.[3] ..... D05B 1/12; D05B 57/08

[52] U.S. Cl. ..... 112/184; 112/228

[58] Field of Search ..... 112/229, 230, 231, 242, 112/181, 184, 191, 228

[56] References Cited

U.S. PATENT DOCUMENTS

| | | | |
|---|---|---|---|
| 1,995,278 | 3/1935 | Kessler | 112/181 X |
| 2,154,403 | 4/1939 | Karle | 112/231 |
| 2,178,543 | 11/1939 | Rubel et al. | 112/281 |
| 2,680,417 | 6/1954 | Graesser | 112/181 |
| 2,694,373 | 11/1954 | Covert et al. | 112/181 |

*Primary Examiner*—Wm. Carter Reynolds

*Attorney, Agent, or Firm*—Karl F. Ross; Herbert Dubno

[57] ABSTRACT

A double-lock-stitch sewing machine has a reciprocating needle forming an upper-thread loop with the aid of a rotary gripper assembly. The loop is carried by and formed by a main hook or point of the assembly around a stationary bobbin to engage a bobbin thread in a double-lock-stitch. A counter hook or counter point on the gripper assembly, which normally serves only to control movement of the loop from the main point, is formed on an underside with an auxiliary hook portion for drawing an extra thread length from the supply during each stitch and thus inhibiting bunching of the workpiece.

7 Claims, 4 Drawing Figures

ROTARY-GRIPPER COUNTER-HOOK FOR DOUBLE-LOCK-STITCH SEWING MACHINES

CROSS REFERENCE TO RELATED APPLICATIONS

This application is a continuation in part of Ser. No. 214,113 filed Dec. 8, 1980 as a continuation of Ser. No. 005,781 filed Jan. 23, 1979, both now abandoned.

FIELD OF THE INVENTION

Our present invention is related to double-lock-stitch sewing machines. In particular, our invention relates to a counter or trailer hook or point of a rotary loop gripper in a double-lock-stitch sewing machine.

BACKGROUND OF THE INVENTION

It is well known in the art of double-lock-stitch sewing machines that an upper thread is carried by a needle through a stitch plate to form therebelow a bight which is looped by a rotary hook or gripper assembly about a bobbin thread to form a lock stitch.

The gripper assembly includes a main hook or point for engaging the upper-thread loop at the moment of its formation and passing it around a substantially stationary bobbin, whereupon the loop is taken up by a counter hook on the gripper assembly in order to prevent its moving about and possible re-engagement by the main hook.

The counter gripper or counter point has a generally frictionless lower edge facilitating acceptance of the loop from the main hook and guiding the loop as it moves prior to the formation of a subsequent stitch. The lower edge of the counter hook is rendered nearly friction-free by adapting the edge's angle of inclination to the movement of thread-control lever of the particular machine.

The above-described double-lock-stitch sewing machine performs excellently under usual circumstances. However, in the case of ornamental stitching, which generally utilizes heavier thread and greater stitch lengths, such a machine will produce a seam which bunches the material.

OBJECTS OF THE INVENTION

The object of our present invention is to provide a double-lock-stitch sewing machine which does not bunch the material being sewn, even under extraordinary conditions such as presented by ornamental stitching.

Another object of the invention is to extend the principles of our copending application Ser. No. 214,113 mentioned above and now abandoned.

SUMMARY OF THE INVENTION

A double-lock-stitch machine has a reciprocating needle feeding an upper thread through a stitch plate to form, with the aid of a rotary gripper assembly therebelow, an upper-thread loop for engagement with a lower thread from a bobbin seated on the gripper assembly. The gripper assembly includes a main hook or point and a counter hook or point each disposed along a periphery of the gripper assembly and the sewing machine further comprises an upper-thread control lever for contracting a loop dilated by the gripper assembly.

Whereas the counter point of a conventional rotary gripper assembly of the type upon which the present invention is an improvement, provides a guide function exclusively, we have found that bunching in the case of sewing light-weight articles with heavy thread and under the conditions described previously can be eliminated when this counter point or hook has the additional function of drawing an added length of thread from the supply upon its engagement with the upper-thread loop formed on the main point or hook.

Consequently, in the system of the present invention, means is provided in the form of the main hook or point for forming an upper thread loop of a predetermined thread length and, during the very same stitch formation, another means on the rotary gripper is provided to engage this loop and draw an additional length of thread from the thread supply.

In other words, when the system of the present invention is compared with prior art systems utilizing rotary grippers rotatable about a vertical axis and having a main hook or point and a counter hook or point on the periphery of the rotatable member, one can find that a given length of upper thread loop is formed by the main point or hook in both the conventional system and the system of the present invention, but that the length of thread during the formation of each stitch in the upper thread loop is at its maximum prior to the time during this stitch formation that the counter point engages the loop. In the system of the present invention, by contrast with earlier systems, upon engagement of the upper thread loop when it is cast off by the main hook, upon the counter hook, this counter hook draws an additional stretch of upper thread from the upper-thread supply and ultimately release this enlarged or augmented loop as it rides upwardly along the lower edge of the counter hook or point.

According to the invention, therefore, an auxiliary portion is provided upon the counter hook or point beyond the limiting surface which would be required for simple guiding of the loop formed by the main hook or point, to draw the additional length of thread from the upper thread supply and increase the length of the loop while the latter is engaged by the counter point or hook.

The additional length of thread resulting from the added portion of the counter point has been found to eliminate bunching when heavier threads are utilized as is the case with ornamental sewing.

According to another feature of our present invention, the lower edge of the counter hook conformed with the auxiliary hook portion lies within two degrees of a 45° angle (i.e. 45°±2°) made with respect to a plane perpendicular to the axis of rotation of the gripper assembly. The auxiliary hook portion may be unitary with the counter hook and the counter hook may be removably secured to the gripper assembly.

According to yet another feature of our present invention, a method for double-lock-stitch sewing a workpiece includes the steps of forming an upper-thread loop, winding this loop about a lower thread and delaying the contraction of the loop, thereby inhibiting bunching of a workpiece through the provision of adequate loop length.

BRIEF DESCRIPTION OF THE DRAWING

These and other features of our present invention will now be described in detail, reference being made to the accompanying drawing in which.

SPECIFIC DESCRIPTION

Figure 1:
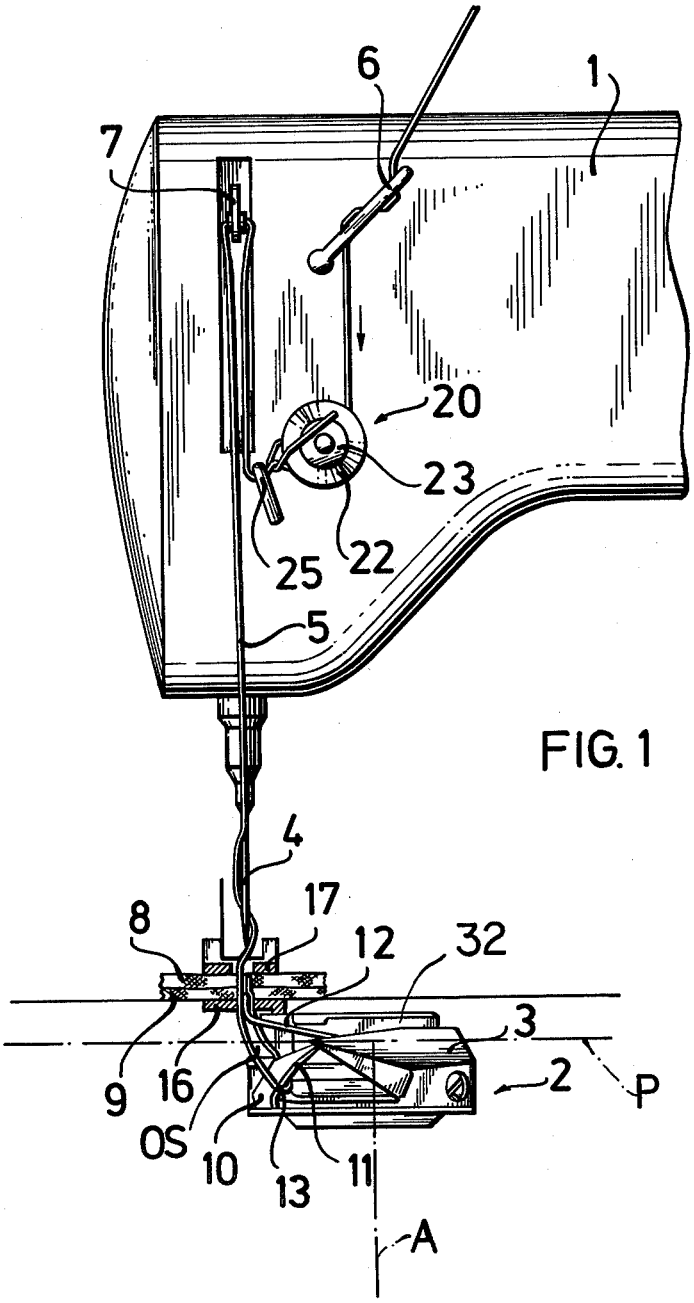
FIG. 1 is a partial side view of a sewing machine, showing a rotary gripper assembly provided with a counter hook according to our invention.
Figure 2:
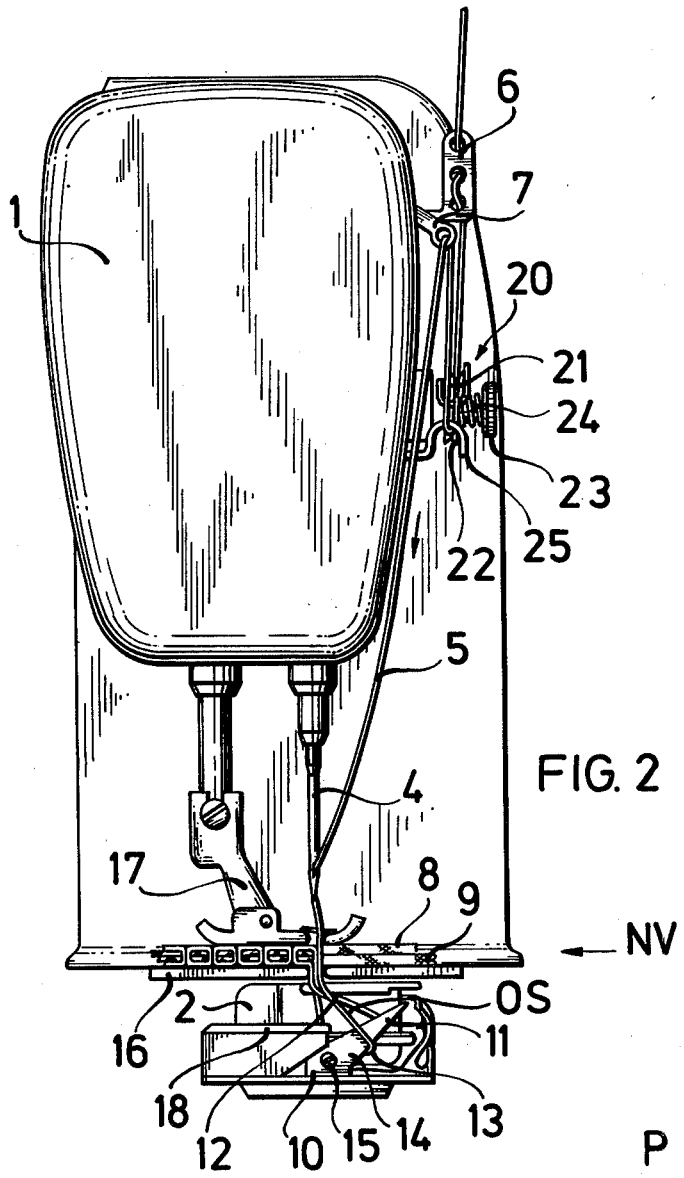
FIG. 2 is an elevational view of the sewing machine shown in FIG. 1.
Figure 4:
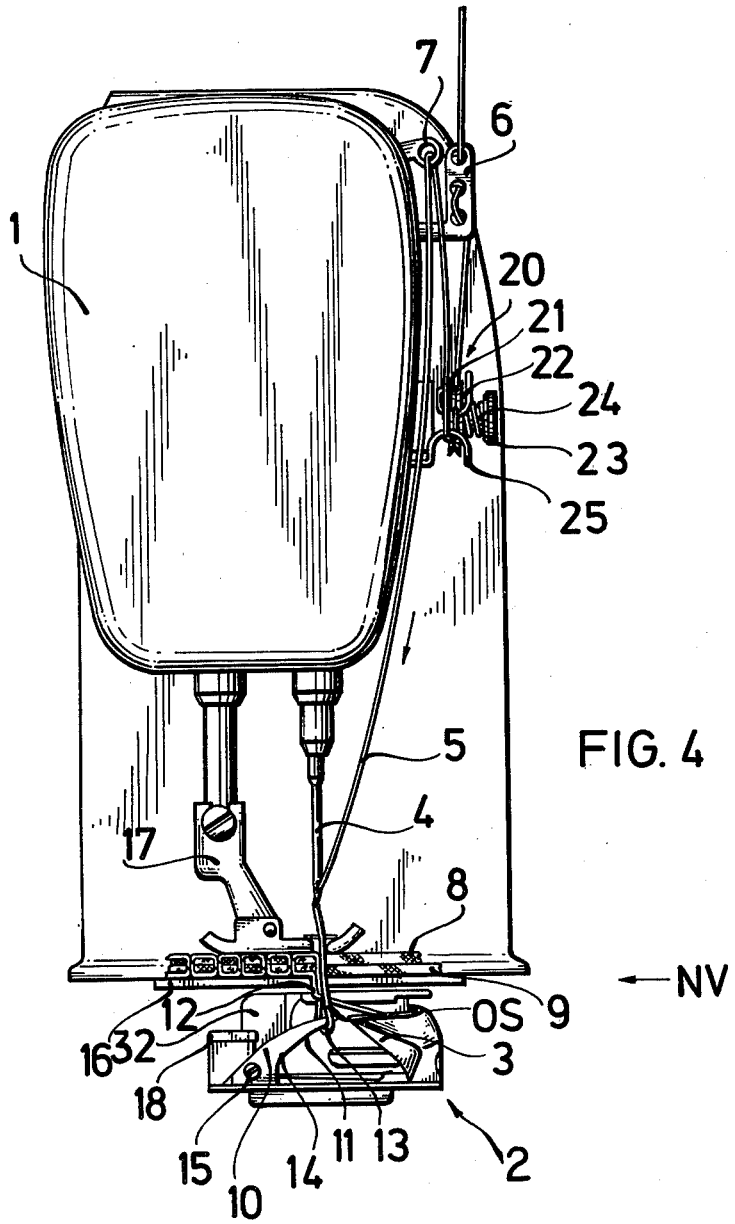
FIG. 4 is a view similar to that shown in FIG. 2.

In FIGS. 1, 2 and 4 we have shown a sewing machine arm or support 1 carrying a thread guide 6 having three bores successively traversed by an upper thread 5 which passes from a source such as a spool (not shown) to a thread-tension adjuster 20. This adjuster comprises a pair of friction disks 21, 22 clamped together by a compressed spring 24 with a force regulatable by a nut 23.

Thread 5 is fed from thread-tension adjuster 20 around a hook or half-loop 25 and through the eye of a control lever 7 to the eye of a reciprocating needle 4.

The needle carries the thread 5 through a lowered fabric clamp 17, through a workpiece including an upper fabric portion 8 and a lower fabric portion 9, and through a stitch plate 16 to form a loop OS therebelow.

It is well known in the art that, upon the beginning of an upstroke by the needle 4, a bottom segment (bight) 13 of loop OS is engaged by a main hook 3 of a gripper assembly 2 which is coupled to a shaft (not shown) for rotation about an axis A (FIG. 1).

Hook (initial or main point) 3, disposed at the periphery of rotary gripper assembly or body 2, carries loop OS around a substantially stationary bobbin 32 seated at the center of assembly 2, thereby engaging a lower or bobbin thread 12 with upper thread 5 to form a double lock stitch.

Prior to the completion of a cycle of rotation of assembly 2 and upon the looping of bobbin thread 12 by needle thread 5, lever 7 initiates an upward stroke contracting loop OS and drawing it off of main hook 3 and onto a second hook (counter point) 10 disposed counter to the main hook at the periphery of the gripper assembly.

It is thus apparent that the main hook 3 forms the loop OS of a given length or size from a predetermined length of upper thread 5 drawn from the upper thread supply (not shown).

In conventional systems, the counter point or hook has contours, e.g. the surface SP, which are dimensioned with respect to the main hook 3 or the loop size such that the size of the loop is at a maximum as determined by the main hook, i.e. the loop may contract but it does not increase in size upon engagement by the counter hook 10.

Figure 3:
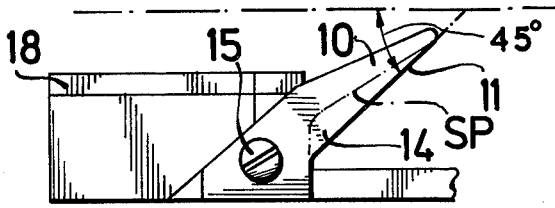
FIG. 3 is a detailed view of the gripper asembly illustrated in FIGS. 1 and 2.

With the system of the present invention, when ornamental stitching is to be effected with heavy thread, the usual counter hook is replaced by the one shown in FIG. 3 having the additional portion 14 thereon which extends the length of the surface 11 along which the loop OS can slide and which, in addition, by engagement with the loop OS draws an additional length of the upper thread 5 from the supply for the stitch in formation.

As illustrated in detail in FIG. 3, therefore, the auxiliary hook portion 14 can be seen to be formed on the underside or bottom edge SP of hook 10, this edge extending at an angle of approximately 30° with respect to a plane P which is perpendicular to the axis of rotation A of assembly 2 (see FIG. 1) so that the edge 11 includes an angle of 45°±2° with plane P (FIG. 3).

It is conventional in the art to adapt edge SP to the upward motion of lever 7, the rotary motion of assembly 2 and the motion of workpiece 8, 9 in the direction of arrow NV (FIGS. 2 and 4) to provide a substantially friction-free incline along which loop segment 13 glides during the contraction of loop OS due to the upward motion of lever 7.

In the system of the present invention, the additional portion 14 has an active role during the formation of each stitch, namely, that of dragging an additional length of thread from the upper thread supply and increasing the length of the loop beyond the maximum established in prior art systems by the main hook or point. The additional length of upper thread now incorporated in the loop by the active counter hook has been found to prevent bunching of the workpieces 8, 9.

The resistance of bottom edge 11 begins during an initial stage of the upstroke of lever 7, as shown in FIGS. 1 and 2, and continues until lever 7 has reached the top of its stroke and loop OS slips off the tip of hook 10, as illustrated in FIG. 4.

The additional thread pulled from the supply by the added portion 14 of the counter point enables the formation of bunch-free seams even in ornamental stitching using heavy or elastic thread and long stitches and even if the workpiece is composed of especially thin material.

As illustrated in FIG. 3, counter hook 10 is secured to gripper assembly 2 by means of a screw 15 to facilitate replacement by another hook in the event of a different type of stitching being taken up. Alternatively, hook 10 together with auxiliary portion 14 may be formed integrally with assembly 2 or a part thereof such as a cover plate 18 (FIGS. 2–4) of a bobbin raceway (not shown). Another possibility includes the formation of hook 10 and hook portion 14 as bent wire segments. The curvature of hook portion 14 and the pressure exerted by adjuster 20 may be varied to precisely control the amount of additional thread drawn from the supply by the added portion 14.

We claim:

1. In a double-lock-stitch sewing machine having a reciprocating needle feeding an upper thread through a stitch plate to form, with the aid of a rotary gripper assembly therebelow, an upper-thread loop for engagement with a lower thread from a bobbin seated on said gripper assembly, said gripper assembly including a main hook and a counter hook each disposed along the periphery of said gripper assembly said main hook imparting a predetermined length to said upper-thread loop and said counter hook guiding said upper-thread loop upon its release by said main hook, the improvement which comprises means including an auxiliary hook portion formed upon an underside of said counter hook and drawing an additional length of said upper thread from a supply thereof into said upper-thread loop during each stitch to inhibit bunching of a workpiece being sewn.

2. The improvement as defined in claim 1 wherein said lower edge is at an angle of 45°±2° with respect to a plane perpendicular to the axis of rotation of said gripper assembly.

3. The improvement as defined in claim 1 or claim 2 wherein said auxiliary hook portion is unitary with said counter hook, said counter hook being removably secured to said gripper assembly.

4. In a double-lock-stitch sewing machine having a thread controller (7) an upwardly and downwardly movable needle (4) forming an upper thread loop (OS) and a gripper body (2) rotatable about a vertical axis and receiving a lower thread bobbin with two gripper points (3, 10) successively engaging each upper thread loop (OS), the gripper points lying along the periphery of the gripper body and being turned in opposite directions toward one another and constituting an initial-engagement point (3) and a counter point (10) respectively, the improvement wherein:

the thread guide flank (11) of the counterpoint (10), relative to the usual length thereof engaged by the bight (13) of the upper thread loop (OS) during the upward stroke of the controller (7), is provided with a rearward extension (14) retarding the withdrawal of the upper thread loop (OS) and actively increasing the length of the loop (OS) during the formation of each stitch.

5. The improvement defined in claim 4 wherein the counterpoint (10) is fastened replaceably upon the gripper body (2).

6. The improvement defined in claim 5 wherein the counterpoint is affixed to the gripper body by a screw (15).

7. The improvement defined in claim 6 wherein the thread controller (7) is an upwardly and downwardly swingable lever, the upper thread passing through a tension-controlling device (20) before passing through an eye in said lever (7), and a thread guide (6) having three bores successively transversed by the upper thread ahead of said device.

* * * * *